US007847774B2

(12) United States Patent
Chang

(10) Patent No.: US 7,847,774 B2
(45) Date of Patent: Dec. 7, 2010

(54) ACTIVE MATRIX ORGANIC LIGHT EMITTING DIODE (AMOLED) DISPLAY, A PIXEL DRIVING CIRCUIT, AND A DRIVING METHOD THEREOF

(75) Inventor: Yi-Cheng Chang, Taipei (TW)

(73) Assignee: AU Optronics Corporation, Hsinchu (TW)

( * ) Notice: Subject to any disclaimer, the term of this patent is extended or adjusted under 35 U.S.C. 154(b) by 663 days.

(21) Appl. No.: 11/055,686

(22) Filed: Feb. 11, 2005

(65) Prior Publication Data

US 2006/0001616 A1 Jan. 5, 2006

(30) Foreign Application Priority Data

Jun. 30, 2004 (TW) ..... 93119679 A

(51) Int. Cl.
*G09G 3/30* (2006.01)
*G09G 3/32* (2006.01)

(52) U.S. Cl. ..... 345/94; 345/76; 345/82

(58) Field of Classification Search ..... 345/76, 345/82, 94
See application file for complete search history.

(56) References Cited

U.S. PATENT DOCUMENTS

| | | | | |
|---|---|---|---|---|
| 5,999,150 | A * | 12/1999 | Nighan et al. | 345/79 |
| 6,677,713 | B1 | 1/2004 | Sung | 315/169.1 |
| 6,680,580 | B1 | 1/2004 | Sung | 315/169.3 |
| 6,777,886 | B1 | 8/2004 | Lo et al. | 315/169.1 |
| 2003/0107565 | A1 * | 6/2003 | Libsch et al. | 345/211 |
| 2004/0100203 | A1 * | 5/2004 | Kobayashi et al. | 315/169.3 |

FOREIGN PATENT DOCUMENTS

| | | |
|---|---|---|
| CN | 1622148 | 6/2005 |
| TW | 558699 | 8/1991 |
| TW | 564390 | 9/1991 |
| TW | 571281 | 1/2004 |
| TW | 200516530 | 5/2005 |

OTHER PUBLICATIONS

Chiang et al., Chun-sung; Electrical Instability of Hydrogenated Amorphous Silicon Thin-Film Transistors for Active-Matrix Liquid-Crystal Displays; Sep. 1998; pp. 4704-4710.
Oritsuki et al., Ryoji; Threshold Voltage Shift of Amorphous Silicon Thin-Film Transistors During Pulse Operation; Dec. 1991; pp. 3719-3723.

* cited by examiner

*Primary Examiner*—Kevin M Nguyen
(74) *Attorney, Agent, or Firm*—Thomas, Kayden, Horstemeyer & Risley, LLP

(57) ABSTRACT

A pixel driving circuit of an active matrix organic light emitted diode display is provided with an input first scanning voltage signal and an input displaying voltage signal. The pixel driving circuit comprises a driving thin film transistor (TFT), an organic light emitted diode (OLED), and a capacitor. The capacitor has a first end connected to a gate electrode of the driving TFT to store a potential respect to the displaying voltage signal and having the driving TFT generate a steady current flowing through the OLED. The capacitor has a second end provided with a second scanning voltage signal, which has a level range larger than that of the displaying voltage signal, partially overlapping with the first scanning voltage signal so as to generate a negative bias in the driving TFT.

6 Claims, 4 Drawing Sheets

ACTIVE MATRIX ORGANIC LIGHT EMITTING DIODE (AMOLED) DISPLAY, A PIXEL DRIVING CIRCUIT, AND A DRIVING METHOD THEREOF

BACKGROUND OF THE INVENTION (1) Field of the Invention

This invention relates to an active matrix organic light emitting diode (AMOLED) display, a pixel driving circuit, and a driving method thereof, and more particularly to a voltage-driven AMOLED display.

(2) Description of the Related Art

With the progress in the fabrication technology of organic light emitting diodes (OELDs), an organic light emitting display with a plurality of OLEDs arranged in matrix has become a popular choice among all the flat panel displays. Based on different driving methods, the organic light emitting display can be sorted into simple matrix system type and active matrix system type. In addition, the active matrix system type is more suitable for large size displays and high resolution usage.

FIG. 1 shows a circuit diagram of a pixel driving circuit in a traditional voltage-driven active matrix organic light emitting display. The pixel driving circuit includes an OLED, a transistor T1, a transistor T2, and a capacitor C. A source electrode of the transistor T1 is connected to a data line D1 for receiving a driving voltage signal $V_D$. A gate electrode of the transistor T1 is connected to a scan line S1. A source electrode of the transistor T2 is connected to an anode of the OLED. A drain electrode of the transistor T2 is provided with a potential $V_{dd}$. A gate electrode of the transistor T2 is connected to a drain electrode of the transistor T1. A cathode of the OLED is provided with a different potential $V_{ss}$. Both ends of the capacitor C are connected to the gate electrode of the transistor T2 and provided with the potential $V_{dd}$ respectively.

As to generate a steady current I passing through the OLED to maintain the brightness, a scanning voltage $V_S$ is firstly applied through the scan line S1 to turn on the transistor T1. Then, a driving voltage signal $V_D$ on the data line D1 is able to apply to the gate electrode of the transistor T2 and create a potential $V_{cs}$ stored in the capacitor C. It is understood that the potential $V_{cs}$ equals to a difference of the voltage levels of $V_{dd}$ and the driving voltage signal $V_D$. Therefore, the gate to source voltage Vgs (not shown) of the transistor T2 is determined. Since a difference between the gate to source voltage Vgs and the threshold voltage Vt of the transistor T2 determines the value of current I, the brightness of the OLED may be decided by setting the value of the driving voltage signal $V_D$.

Although the usage of amorphous silicon thin film transistor (a-Si TFT) can reduce the cost of an organic light emitting display, most of the thin film transistors (TFT) applied for driving OLEDs nowadays are made of low temperature polysilicon (LTPS) technology due to a major consideration of a shifting threshold voltage Vt of an a-Si TFT during operation. That is, even the gate to source voltage Vgs of the transistor remains constant, the value of the current passing through the OLED may be reduced due to the increasing threshold voltage Vt, and a decreasing brightness of the OLED is predictable.

The total variation of the threshold voltage Vt of the a-Si TFT is equal to a sum of the variations under positive bias and negative bias, which is disclosed in "Threshold Voltage Variation of Amorphous Silicon Thin-Film Transistor During Pulse Operation" of Japanese Journal of Applied Physics Vol. 30, December, 1991, pp. 3719-3723. Furthermore, the variation of the threshold voltage under positive bias is positive, and the variation of the threshold voltage under negative bias is negative, which is disclosed in "Electrical Instability of Hydrogenated Amorphous Silicon Thin-Film Transistors for Active-Matrix Liquid-Crystal Displays" of Japanese Journal of Applied Physics Vol. 37, September, 1998, pp. 4704-4710.

As mentioned above, the problem of increasing threshold voltage of the a-Si TFT can be effectively resolved by having the a-Si TFT properly supplied with negative bias. Therefore, modifying the pixel driving circuit by providing the TFT with negative bias is quite helpful for the application of a-Si TFT for driving OLEDs.

SUMMARY OF THE INVENTION

It is a main object of the present invention to generate a negative bias to a driving thin film transistor (TFT) in a pixel driving circuit so as for driving an OLED to overcome the problem of increasing threshold voltage.

A pixel driving circuit of a voltage-driven active matrix organic light emitting display is provided in the present invention. The pixel driving circuit is applied with a first scanning voltage signal and a displaying voltage signal, and it comprises a driving transistor, an organic light emitting diode (OLED) connected to the driving transistor, and a capacitor having a first end connected to a gate electrode of the driving transistor to store a potential respect to the displaying voltage signal so as to generate a steady current passing through the OLED. A second end of the capacitor is provided with a second scanning voltage signal, which partially overlaps with the first scanning voltage signal and has a level range larger than that of the displaying voltage signal so as to generate a negative bias in the driving transistor.

By using the above mentioned pixel driving circuit, a method for voltage-driving an organic light emitting display is provided in the present invention. Firstly, the pixel driving circuit is provided with the first scanning voltage signal and the second scanning voltage signal. The scanning voltage signals does not have any overlap so as to operate the pixel driving circuit ordinarily. As a negative bias is desired to be provided in the driving transistor, the first scanning voltage signal and the second scanning voltage signal are overlapped to generate a negative voltage level to the first end of the capacitor for generating the negative bias.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
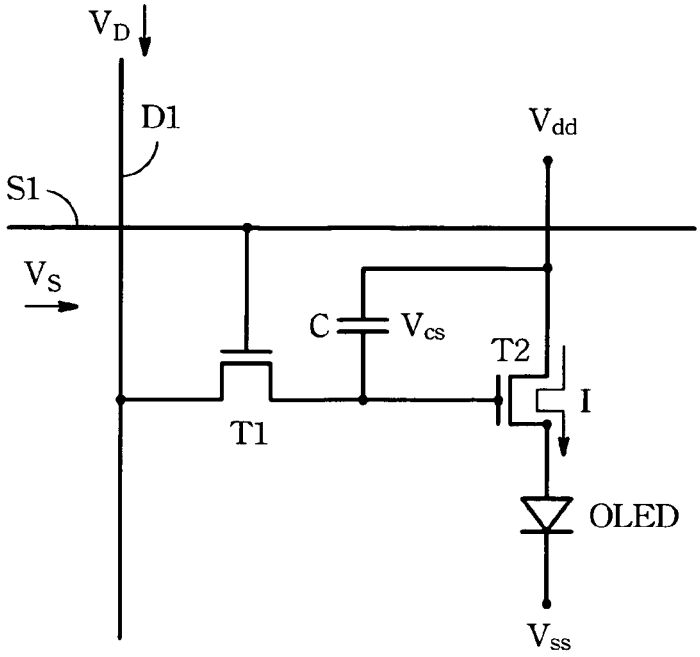
FIG. 1 (Related Art)
FIG. 1 is a circuit diagram depicting a traditional pixel driving circuit of a voltage-driven active matrix organic light emitting display.
Figure 2:
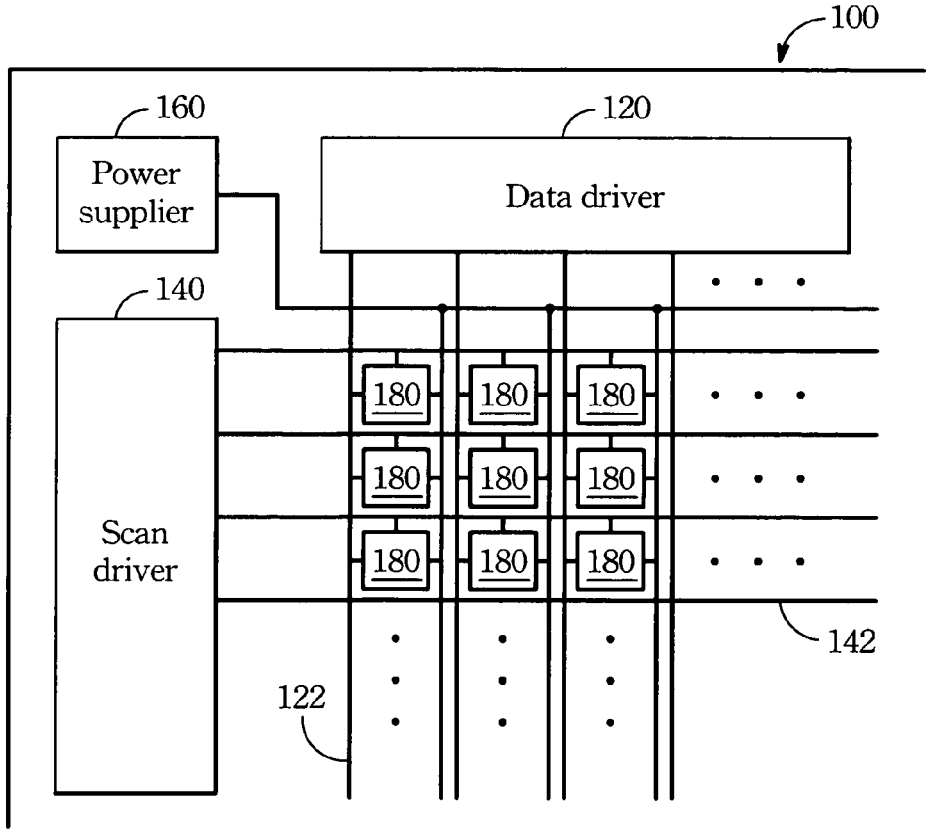
FIG. 2 is a functional block diagram depicting a preferred embodiment of an active matrix organic light emitting display in accordance with the present invention.

FIG. 2 is a functional block diagram depicting a preferred embodiment of an active matrix organic light emitting display in accordance with the present invention. As shown, the organic light emitting display includes a substrate 100, a data driver 120 arranged on the substrate 100, a scan driver 140 on the substrate 100, a power supplier 160, a plurality of scan lines 122, a plurality of data lines 142 perpendicular to the scan lines 122, and a plurality of pixel driving circuits 180 arranged on the substrate 100 in matrix. The pixel driving circuits 180 of the same column is connected to the data driver 120 through a single data line 122. The pixel driving circuits 180 of the same row is connected to the scan driver 140 through a single scan line 142. The power supplier 160 located on the substrate 100 is utilized for applying power to activate the organic light emitting diodes (OLEDs) of each pixel driving circuits 180.

Figure 3:
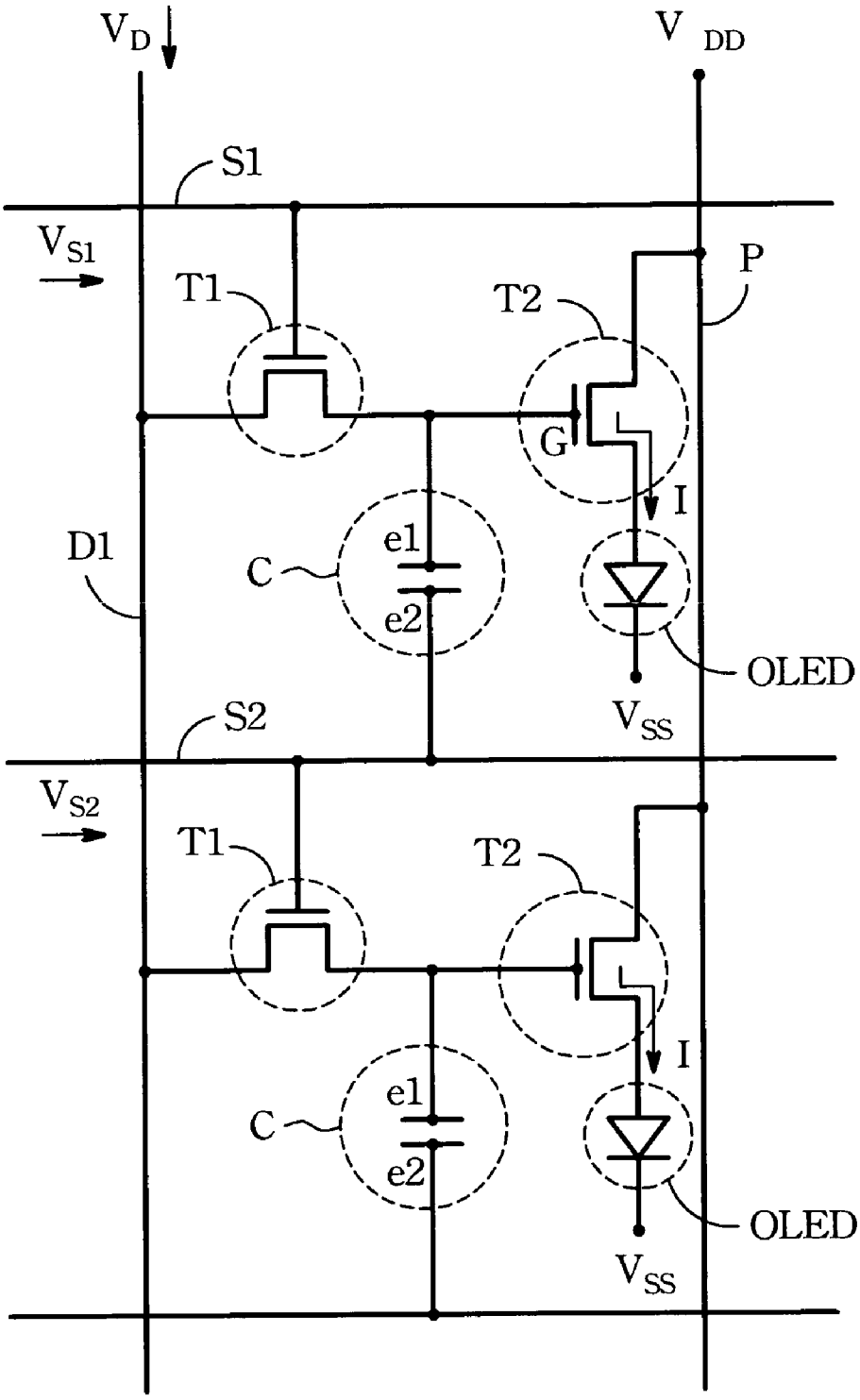
FIG. 3 is a circuit diagram depicting a pixel driving circuit shown in FIG. 2.

FIG. 3 is a circuit diagram depicting a pixel driving circuit 180 of FIG. 2, and two adjacent pixel driving circuits 180 of the same column is shown. As shown in FIG. 3, each pixel driving circuit 180 includes a switching transistor T1, a driving transistor T2, an OLED, and a capacitor C. The switching transistor T1 has a source electrode connected to a data line D1 (identical to the data line 122 of FIG. 2) for receiving a displaying voltage signal $V_D$, a gate electrode connected to a first scan line S1 (identical to the scan line 142 of FIG. 2) for receiving a first scanning voltage signal $V_{S1}$, and a drain electrode. The driving transistor T2 has a gate electrode connected to the drain electrode of the switching transistor T1, a drain electrode connected to a power line P for receiving a first voltage level $V_{DD}$ generally ranging from 0 to 12 volts, and a source electrode. The OLED has an anode connected to the source electrode of the driving transistor T2 and a cathode provided with a second voltage level $V_{ss}$ generally ranging from 0 to −12 volts. The capacitor C has a first end e1 connected to both the drain electrode of the switching transistor T1 and the gate electrode of the driving transistor T2, and a second end e2 connected to an adjacent scan line S2 for receiving a second scanning voltage signal $V_{S2}$.

As the first scanning voltage signal is at a high level state generally ranging from 0 to 15 volts, the switching transistor T1 is turned on so as to allow the displaying voltage signal $V_D$ generally ranging from 0 to 15 volts passing through the switching transistor T1 and stored in the capacitor C. As the first scanning voltage signal is at a low level state generally ranging from 0 to −15 volts, the switching transistor T1 is turned off to stop input displaying voltage signal $V_D$. At the same time, a potential stored in the capacitor C respect to the displaying voltage signal $V_D$ drives the driving transistor T2 to generate a steady current I passing through the OLED to illuminate.

All the level ranges of the first voltage level $V_{dd}$, the second voltage level $V_{ss}$, the first scanning voltage signal $V_{S1}$, and the second scanning voltage signal $V_{S2}$ are restricted by the allowable loading of the pixel driving circuit 180 and outputs of the data driver 120, the scan driver 140, and the power supplier 160.

It is noted that a scanning timing of the second scanning voltage signal $V_{S2}$ is right behind that of the first scanning voltage signal $V_{S1}$. Therefore, the second scan line S2 connected to the second end e2 of the capacitor C can be regarded as a next scan line with respect to the first scan line S1.

As the first scanning voltage signal $V_{S1}$ does not overlap the second scanning voltage signal $V_{S2}$, the first end e1 of the capacitor C maintains a voltage level of the displaying voltage signal $V_D$. The voltage level of the gate electrode of the driving transistor T2 is thus maintained to a value corresponding to the displaying voltage signal $V_D$ to generate a steady current I passing through the OLED normally.

As the first scanning voltage signal $V_{S1}$ overlaps the second scanning voltage signal $V_{S2}$ and both the first scanning voltage signal $V_{S1}$ and the second scanning voltage signal $V_{S2}$ are in high level state, the first end e1 of the capacitor C has the voltage level of the displaying voltage signal $V_D$ and the second end e2 of the capacitor C has the voltage level of the mentioned high level state. Afterward, as the first scanning voltage signal $V_{S1}$ is switched to the respected low level state but the second scanning voltage signal $V_{S2}$ remains in the high level state, the switching transistor T1 is turned off so as to float the first end e1 of the capacitor C. A difference between the voltage levels of the displaying voltage signal $V_D$ and the high level state generates a potential stored in the capacitor C. Thereafter, as the second scanning voltage signal $V_{S2}$ is further switched to the low level state, the voltage level of the second end e2 of the capacitor C is declined to the voltage level of low level state and leads to a significant decrease of the voltage level of the first end e1 of the capacitor C. It should be noted that the difference between the voltage levels of the high level state and the low level state is usually much greater than the voltage level of the displaying voltage signal $V_D$. Therefore, the voltage level of the first end e1 of the capacitor C can be decreased to a negative value. The negative voltage level is also applied on the gate electrode of the driving transistor T2 to generate a negative bias.

For example, as the displaying voltage signal $V_D$ ranges from 0 to 15 volts, the voltage level of the high level state ranges from 0 to 15 volts, and the voltage level of the low level state ranges from 0 to −15 volts, the potential stored in the capacitor C is predictable to have a voltage level ranging from −15 to 15 volts and the difference between the voltage levels of the high and low level states ranging from 0 to 30 volts. It is understood that the difference between the voltage levels of the high and low level states can be greater than the potential stored in the capacitor C, and thus a negative bias can be generated.

Figure 4:
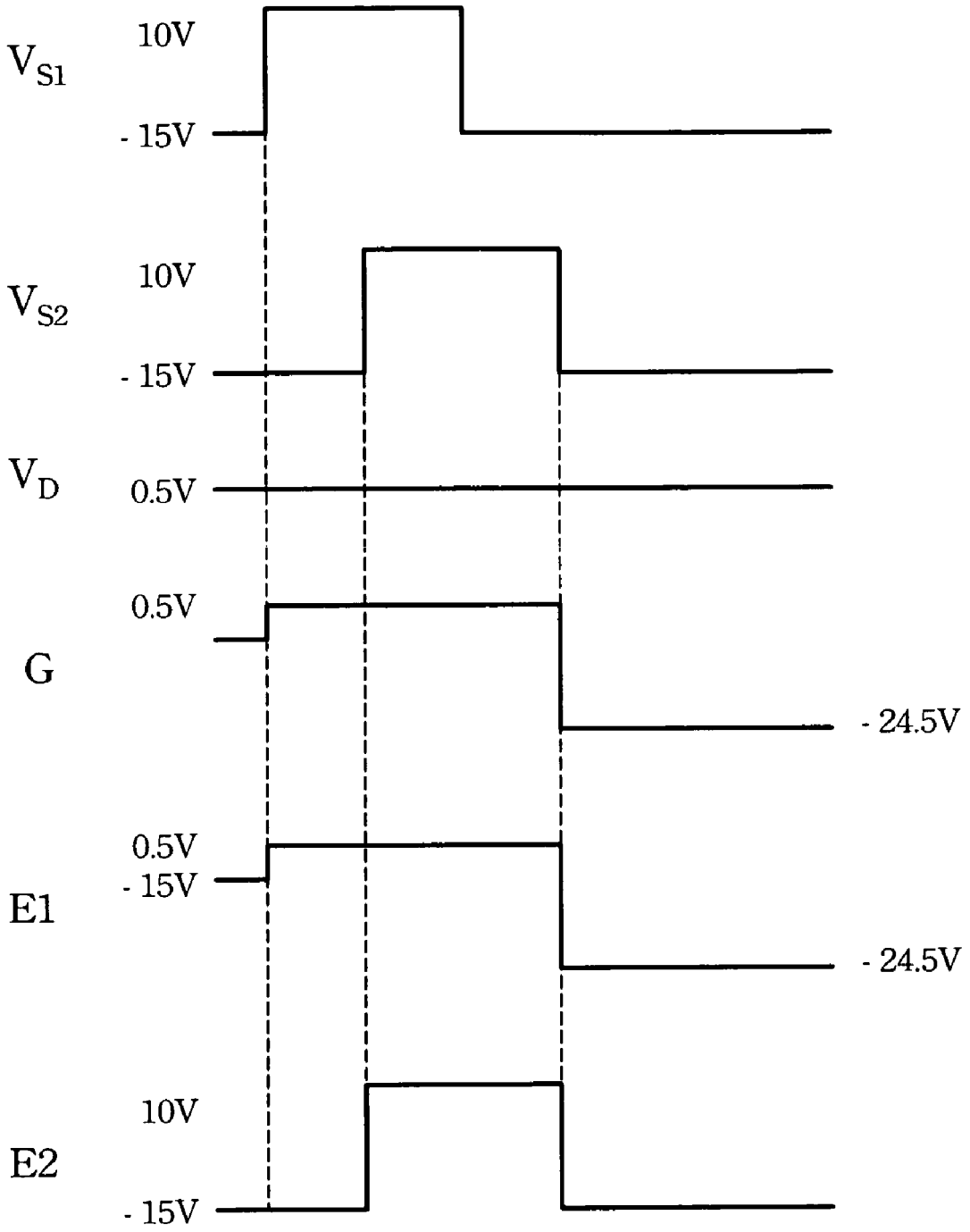
FIG. 4 is a timing chart showing the waveforms of the first scanning voltage signal, the second scanning voltage signal, the displaying voltage signal, and the voltage applied on the gate electrode of the driving transistor.

For a better understanding of the generation of the negative bias, please referring to FIG.4, which shows a timing chart depicting the waveforms of the first scanning voltage signal $V_{S1}$, the second scanning voltage signal $V_{S2}$, the displaying voltage signal $V_D$, voltage level of the gate electrode G of the driving transistor T2, and voltage levels of the first end el (denoted El) and the second end e2 (denoted E2) of the capacitor C, respectively. As shown in FIG.4, both the first scanning voltage signal $V_{S1}$, and the second scanning voltage signal $V_{S2}$ are pulse signals. It is assumed that the voltage level of the high level state of both the first scanning voltage signal $V_{S1}$, and the second scanning voltage signal $V_{S2}$ is 10 volts, and the respected voltage level of the low level state is −15 volts. It is also assumed that the voltage level of the displaying voltage signal $V_D$ is 0.5 volt.

In the timing chart shown in FIG. 4, as both the first scanning voltage signal $V_{S1}$ and the second scanning voltage signal $V_{S2}$ are in the high level state of 10 volts, the voltage levels E1 and E2 are 0.5 volts and 10 volts respectively. Then, as the first scanning voltage signal $V_{S1}$ is in the low level state of −15 volts to turn off the switching transistor T1, a potential of −9.5 volts, which is also a difference of voltage levels between the first end e1 and the second end e2, is stored in the capacitor C. Thereafter, as the second scanning voltage signal $V_{S2}$ is at the low level state of −15 volts, the second end e2 of the capacitor C is forced to shift to a voltage level of −15 volts. Since the difference of voltage levels between the first end e1 and the second end e2 is kept constant, the voltage level of the first end e1 of the capacitor is thus reduced to −24.5 volts and applied to the gate electrode G of the driving transistor T2 to generate a negative bias.

Although the switching transistor T1 and the driving transistor T2 in the pixel driving circuit of FIG. 3 may be polysilicon thin film transistors or amorphous silicon thin film transistors (a-Si TFTs). It is understood that a major objective of the present invention is to generate a negative bias in the driving transistor T2 to extend the expecting life of the driving transistor. Therefore, the pixel driving circuit of the present invention is particularly suitable for using amorphous silicon thin film transistors as the driving transistor T2. Whereas, since the time of applying positive bias on the switching transistor T1 is much shorter than that on the driving transistor T2, the switching transistor T1 in the pixel circuit 180 of the present invention is not limited to use polysilicon thin film transistors.

Figure 5:
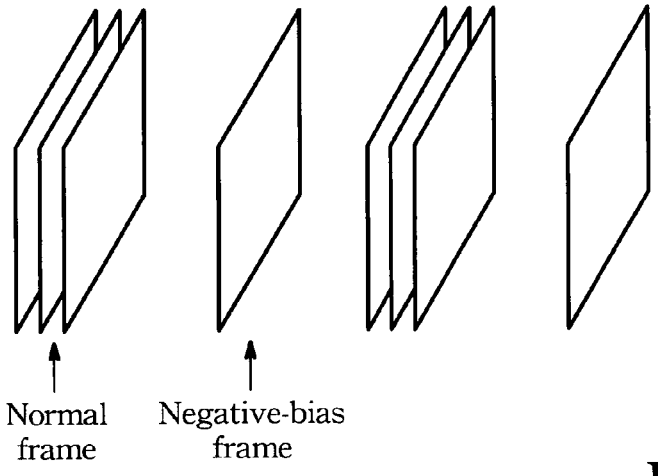
FIG. 5 shows a schematic drawing of a driving method by using the driving circuit shown in FIG. 2.
Figure 6A:
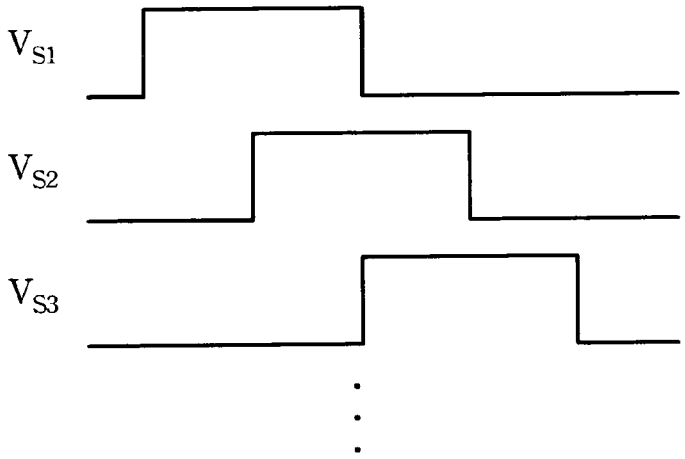
FIG. 6A is a timing chart showing the waveforms of the overlapped first and second scanning voltage signals.
Figure 6B:
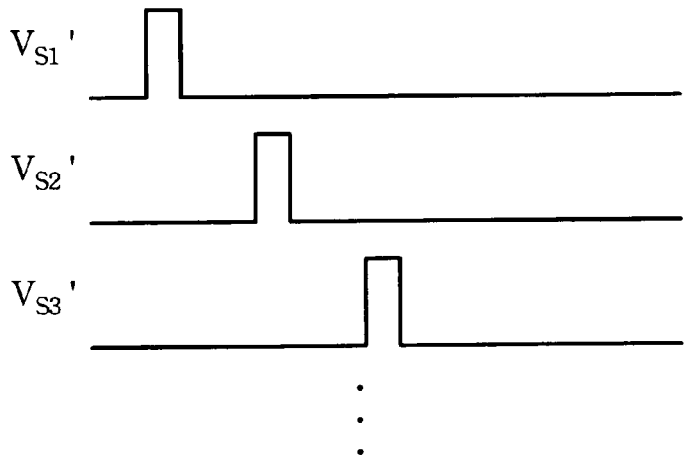
FIG. 6B is a timing chart showing the waveforms shows the waveforms of the non-overlapped first and second scanning voltage signals.

FIG. 5 shows a schematic drawing of a voltage-driving method by using the driving circuit 100 shown in FIG. 2. In the present voltage-driving method, the input scanning voltage signals provided by the scan lines 142 can be sorted into the scanning voltage signals with overlapping $V_{S1}$, $V_{S2}$, $V_{S3}$ . . . to generate negative bias in a first cycle, as shown in FIG. 6A, and the scanning voltage signals without overlapping $V_{S1}'$, $V_{S2}'$, $V_{S3}'$ . . . to operate the pixel driving circuit ordinary to show normal frames in a second cycle, as shown in FIG. 6B. In FIG. 5, the scanning voltage signals without overlapping and the scanning voltage signals with overlapping are alternatively provided to the driving circuit 100. That is, negative-bias frames formed by applying scanning voltage signals with overlapping are periodically provided to interpose between a predetermined number of the normal frames for adjusting the threshold voltage of the driving transistor in the pixel driving circuits 180. The predetermined number may be reduced to one to help preventing the increasing of threshold voltage.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

I claim:

1. A method for driving an active matrix organic light emitting display having a driving transistor and an organic light emitting diode, comprising:

(a) providing, in a first cycle, a first scanning voltage signal of the first cycle to a first scan line and a second scanning voltage signal of the first cycle to a second scan line, wherein the second scan line is the next scan line to the first scan line, and the second scanning voltage signal of the first cycle does not overlap the first scanning voltage signal of the first cycle, wherein said first scanning voltage signal of the first cycle and said second scanning voltage signal of the first cycle are both pulse signals; and (b) providing, in a second cycle, a first scanning voltage signal of the second cycle to the first scan line and a second scanning voltage signal of the second cycle to the second scan line, wherein the second scanning voltage signal of the second cycle overlaps the first scanning voltage signal of the second cycle to generate a negative bias in the driving transistor for driving the organic light emitting diode, wherein step (a) is performed a predetermined number of iterations, and wherein step (b) is performed only upon completion of the predetermined number of iterations of step (a).

2. The method according to claim 1, wherein the difference between a low voltage level and a high voltage level of the first scanning voltage signal of the first cycle ranges from about 0 to 30 V.

3. The method according to claim 1, wherein the difference between a low voltage level and a high voltage level of the second scanning voltage signal of the first cycle ranges from about 0 to 30 V.

4. The method according to claim 1, wherein the difference between a low voltage level and a high voltage level of the first scanning voltage signal of the second cycle ranges from about 0 to 30 V.

5. The method according to claim 1, wherein the difference between a low voltage level and a high voltage level of the second scanning voltage signal of the second cycle ranges from about 0 to 30 V.

6. A method for driving a pixel driving circuit of an active matrix organic light emitting display, said pixel driving circuit including a switching transistor, a driving transistor, an organic light emitted diode (OLED), and a capacitor having a first end connected to said driving transistor and a second end, said method comprising:

(a) providing, in a first cycle, a first scanning voltage signal of the first cycle to a gate of said switching transistor and a second scanning voltage signal of the first cycle to said second end of said capacitor, wherein the second scanning voltage signal of the first cycle does not overlap the first scanning voltage signal of the first cycle; and (b) providing, in a second cycle, a first scanning voltage signal of the second cycle to said gate of said switching transistor and a second scanning voltage signal of the second cycle to said second end of said capacitor, wherein the second scanning voltage signal of the second cycle overlaps the first scanning voltage signal of the second cycle to generate a negative bias in the driving transistor for driving the organic light emitting diode, wherein step (a) is performed a predetermined number of iterations, and wherein step (b) is performed only upon completion of the predetermined number of iterations of step (a).

* * * * *